US009140483B2

(12) United States Patent
Park et al.

(10) Patent No.: US 9,140,483 B2
(45) Date of Patent: Sep. 22, 2015

(54) REFRIGERATOR

(71) Applicant: SAMSUNG ELECTRONICS CO., LTD., Suwon-si (KR)

(72) Inventors: Kyoung Sun Park, Hwaseong-si (KR); Sung Cheul Park, Gwangju (KR); Chul Woo Kim, Gwangju (KR); Hong Joo Mun, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/245,288

(22) Filed: Apr. 4, 2014

(65) Prior Publication Data

US 2014/0300264 A1 Oct. 9, 2014

(30) Foreign Application Priority Data

Apr. 5, 2013 (KR) ..... 10-2013-0037533

(51) Int. Cl.

*A47B 96/04* (2006.01)
*F25D 25/02* (2006.01)
*F25D 17/04* (2006.01)

(52) U.S. Cl.

CPC ..... *F25D 25/025* (2013.01); *F25D 17/042* (2013.01)

(58) Field of Classification Search

CPC ..... F25D 23/087; F25D 25/025; A47B 2210/175; A47B 2210/17; A47B 2088/0011; A47B 2088/0077
USPC ..... 312/402, 404, 296, 408, 330.1
See application file for complete search history.

(56) References Cited

U.S. PATENT DOCUMENTS

| | | | | | |
|---|---|---|---|---|---|
| 2,704,237 | A * | 3/1955 | Nave | 312/404 |
| 2,836,186 | A * | 5/1958 | Guth | 134/57 D |
| 3,837,120 | A * | 9/1974 | Hanks et al. | 49/489.1 |
| 5,641,217 | A * | 6/1997 | Caruso et al. | 312/404 |
| 5,820,239 | A * | 10/1998 | Christenson et al. | 312/334.23 |
| 7,712,852 | B2 * | 5/2010 | Choi et al. | 312/402 |
| 8,590,993 | B2 * | 11/2013 | Lee et al. | 312/404 |
| 2002/0190619 | A1 * | 12/2002 | Brauer | 312/405 |
| 2006/0248916 | A1 * | 11/2006 | Kim et al. | 62/408 |
| 2008/0265733 | A1 * | 10/2008 | Hue et al. | 312/404 |
| 2009/0223242 | A1 * | 9/2009 | Nam et al. | 62/441 |
| 2009/0308094 | A1 * | 12/2009 | Gorz et al. | 62/264 |
| 2009/0309472 | A1 * | 12/2009 | Park et al. | 312/401 |
| 2010/0090574 | A1 * | 4/2010 | Lim et al. | 312/404 |
| 2011/0023530 | A1 * | 2/2011 | An et al. | 62/449 |
| 2011/0037361 | A1 * | 2/2011 | Covert | 312/296 |
| 2012/0112613 | A1 * | 5/2012 | Siegert | 312/404 |

(Continued)

*Primary Examiner* — Hanh V Tran
(74) *Attorney, Agent, or Firm* — Staas & Halsey LLP

(57) ABSTRACT

A refrigerator may allow the inner space of a storage box to be sealed by a gasket disposed between the shelf and the storage box and adjust humidity of the sealed inner space of the storage box by disposing a moisture-permeable membrane on the shelf. The refrigerator includes a body, a storage compartment arranged in the body, a shelf arranged in the storage compartment and provided with an extension portion, a storage box coupled to a lower portion of the shelf, the storage box being provided with an edge portion, a plurality of rails provided at sidewalls of the storage compartment to guide the storage box, the rails being provided with an inclined portion, a gasket coupled to the extension portion of the shelf to seal an inner space of the storage box, and a moisture-permeable membrane arrange at the shelf.

19 Claims, 11 Drawing Sheets

(56) References Cited

U.S. PATENT DOCUMENTS

2012/0273504 A1* 11/2012 Rackley et al. ..... 220/592.02
2013/0059047 A1* 3/2013 Arrigo ..... 426/320
2013/0193822 A1* 8/2013 Nistor ..... 312/296
2013/0257254 A1* 10/2013 Austin et al. ..... 312/404
2013/0270986 A1* 10/2013 Min et al. ..... 312/330.1
2013/0300276 A1* 11/2013 Nuss ..... 312/404
2014/0145579 A1* 5/2014 Anderson et al. ..... 312/404
2014/0265802 A1* 9/2014 Wilcox et al. ..... 312/404

* cited by examiner

REFRIGERATOR

CROSS-REFERENCE TO RELATED APPLICATIONS

This application claims the priority benefit of Korean Patent Application No. 10-2013-0037533, filed on Apr. 5, 2013 in the Korean Intellectual Property Office, the disclosure of which is incorporated herein by reference.

BACKGROUND

1. Field

The following description relates to a refrigerator having a storage box whose inner space is closed by a shelf.

2. Description of the Related Art

A refrigerator, which generally includes a storage compartment and a cool air supply unit to supply cool air to the storage compartment, is an appliance used to keep food fresh.

The storage compartment is maintained within a temperature range required to keep food fresh.

The storage compartment of such a refrigerator is provided with an open front portion. The open front portion is closed by a door mainly to maintain the temperature of the storage compartment.

Provided in the refrigerator are a plurality of shelves to partition the storage compartment into a plurality of sections, and a plurality of storage boxes to allow food to be accommodated in the inner spaces thereof.

Each storage box may be disposed under a shelf. Since the open upper portion of the storage box is not completely closed by the shelf, the humidity of the inner space of the storage box may not be maintained. Accordingly, food stored in the storage box may not be kept fresh.

SUMMARY

Additional aspects and/or advantages will be set forth in part in the description which follows and, in part, will be apparent from the description, or may be learned by practice of the disclosure.

It is another aspect of the present disclosure to provide a refrigerator which may adjust humidity of the sealed inner space of the storage box by disposing a moisture-permeable membrane on the shelf.

Additional aspects of the disclosure will be set forth in part in the description which follows and, in part, will be apparent from the description, or may be learned by practice of the disclosure.

In accordance with one aspect of the present disclosure, a refrigerator includes a body, a storage compartment arranged in the body and having an open front portion, a shelf arranged in the storage compartment and provided, at a lower portion of left, right and rear edges of the shelf, with an extension portion extending downward, a storage box coupled to a lower portion of the shelf such that an open upper portion of the storage box is covered by the shelf and that the storage box is slidably inserted into or withdrawn from the storage compartment, the storage box being provided, at an upper edge of left, right and rear walls of the storage box, with an edge portion horizontally extending, a plurality of rails provided at sidewalls of the storage compartment to guide the storage box such that the storage box is slidably inserted into or withdrawn from the storage compartment, each of the rails being provided, at a rear end portion thereof, with an inclined portion formed to be inclined downward, a gasket coupled to the extension portion of the shelf such that, when the storage box is inserted along the rails into the storage compartment and thereby moved downward along the inclined portion, an upper portion of the gasket closely contact a lower portion of the edge portion of the storage box, sealing an inner space of the storage box, and a moisture-permeable membrane arrange at the shelf to adjust humidity of the sealed inner space of the storage box.

The shelf may be fixed to an inside of the storage compartment to allow an item to be loaded onto an upper portion of the shelf.

The extension portion may include a first extension portion extending downward from the left, right and rear edges of the shelf, and a second extension portion horizontally extending from the first extension portion in an inward direction of the shelf.

The second extension portion may be provided with a fixing portion to allow the gasket to be fixed thereto, and the fixing portion may include a fixing groove having a recessed shape and a fixing step protruding outward.

The gasket may include a hard part to be fixed to the fixing portion, and a soft part having elasticity to closely contact the edge portion of the storage box, the gasket being formed of a material for dual extrusion.

The storage box may include a guide provided on side portions of the storage box to be guided along the rails, and the guide may be provided with a protrusion to restrict a distance the storage box is withdrawn.

Each of the rails may include a horizontal portion horizontally arranged to guide the guide in a horizontal direction such that the storage box is moved into and withdrawn from the storage compartment, and an inclined portion arranged at an end portion of the horizontal portion to be inclined downward to guide the guide in an inclined direction.

The inclined portion may have a length of 50 mm at the end portion of each of the rails.

The inclined portion may be inclined such that a front end portion of the inclined portion is 7 mm higher than the rear end portion of the inclined portion.

When the storage box is moved into the storage compartment, the guide may be guided along the horizontal portion, and after passing the horizontal portion, the storage box may be automatically guided downward along the inclined portion to be moved into the storage box.

Each of the rails may be provided with an engagement step to engage with the protrusion to restrict a distance the storage box is withdrawn.

The shelf may be provided with a seating portion to allow the moisture-permeable membrane to be seated thereon, and a cover may be arranged at an upper portion of the seating portion to prevent the moisture-permeable membrane from escaping the seating portion.

The moisture-permeable membrane may discharge moisture in the inner space of the storage box when the humidity of the sealed inner space of the storage box is high, and may maintain the moisture in the inner space of the storage box when the sealed inner space of the storage box is dry.

In accordance with another aspect of the present disclosure, a refrigerator includes a body, a storage compartment arranged in the body and having an open front portion, a shelf arranged in the storage compartment and provided, at a lower portion of left, right and rear edges of the shelf, with an extension portion to allow a gasket to be fixed thereto, a storage box coupled to a lower portion of the shelf to be inserted into or withdrawn from the storage compartment, the storage box being provided, at an upper edge of left, right and rear walls of the storage box, with an edge portion such that the edge portion is positioned at an upper portion of the gasket, and a plurality of rails provided at sidewalls of the storage compartment to guide the storage box such that the storage box is inserted into or withdrawn from the storage compartment, each of the rails including a horizontal portion to guide the storage box in a horizontal direction, and an inclined portion arranged at an end portion of the horizontal portion to guide the storage box inserted into the storage box the guide in a diagonally downward direction, wherein, when the storage box is moved downward by the inclined portion during movement of the storage box into the storage compartment, the edge portion may press the gasket such that a gap between the shelf and the storage box is sealed by the gasket.

The shelf may be provided with a moisture-permeable membrane to adjust humidity of a sealed inner space of the storage box.

The extension portion may include a first extension portion extending downward from the left, right and rear edges of the shelf, and a second extension portion horizontally extending from the first extension portion in an inward direction of the shelf, wherein the gasket is fixed to the second extension portion.

When the storage box is moved into the storage compartment, the storage box may be horizontally guided by the horizontal portion, and when introduced into the inclined portion via the horizontal portion, the storage box may be guided downward to be automatically moved into the storage box.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
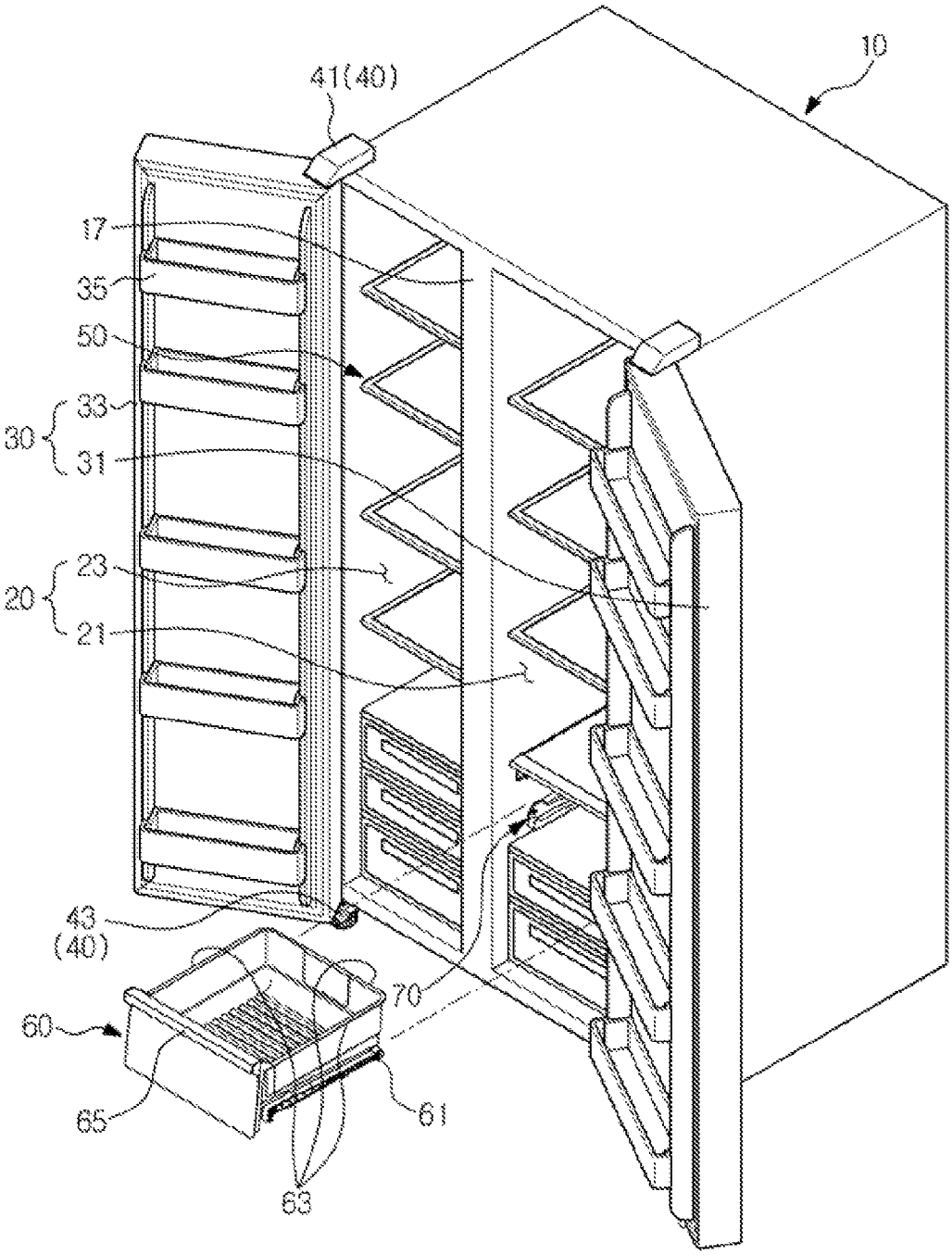
FIG. 1 is a perspective view showing a refrigerator according to an exemplary embodiment of the present disclosure.

Reference will now be made in detail to embodiments of the present disclosure, examples of which are illustrated in the accompanying drawings, wherein like reference numerals refer to like components throughout.

Figure 2:
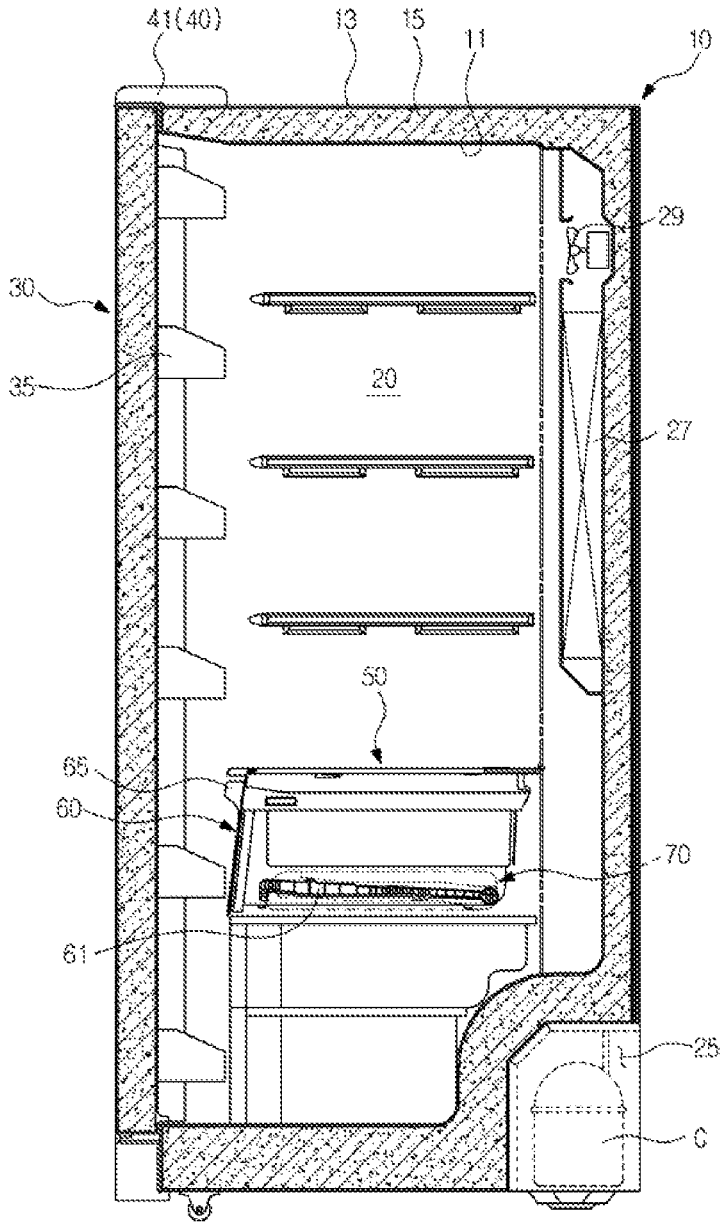
FIG. 2 is a cross-sectional view showing the refrigerator of FIG. 1.

As shown in FIGS. 1 to 2, the refrigerator includes a body 10 to form an external appearance of the refrigerator, a storage compartment 20 arranged in the body 10 such that a front portion thereof is openable, a door 30 to open and close the storage compartment 20, and a hinge module 40 including an upper hinge 41 and a lower hinge 43, which allow the door 30 to be rotatably coupled to the body 10.

The body 10 includes an inner case 11 to form the storage compartment 20, an outer case 13 to form an external appearance of the body 10, and a cool air supply unit to supply cool air to the storage compartment 20.

The cool air supply unit may include a compressor C, a condenser (not shown), an expansion valve (not shown), an evaporator 27, and a fan 29. Thermal insulation 15 is formed between the inner case 11 and the outer case 13 of the body 10 through a foaming process to preserve the cool state of the storage compartment 20.

A machine room 25, in which the compressor C to compress a refrigerant and the condenser to condense the compressed refrigerant are installed, is provided at the lower portion of the rear portion of the body 10.

The storage compartment 20 is partitioned into left and right sections by the partition wall 17. Thereby, a refrigeration compartment 21 is arranged at the right portion of the body 10, and a freezer compartment 23 is arranged at the left portion of the body 10. However, the present disclosure is not limited thereto. For example, a refrigeration compartment may be arranged at the left portion of the body 10 and a freezer compartment may be arranged at the right portion of the body 10. In addition, Further, although as shown in FIG. 1, the partition wall is vertically provided in the refrigerator, the partition wall may be horizontally provided in the refrigerator. In this case, a refrigeration compartment or a freezer compartment may be provided at either an upper portion or a lower portion of the body.

The refrigeration compartment 21 and the freezer compartment 23 are respectively opened and closed by a refrigeration compartment door 31 and a freezer compartment door 33, which are pivotably coupled to the body 10. The rear portion, for example, the rear surface, of each of the refrigeration compartment door 31 and the freezer compartment door 33 is provided with a plurality of door guides 35 to accommodate food.

The storage compartment 20 is provided with a plurality of shelves 50. Accordingly, the storage compartment 20 may be partitioned into a plurality of sections. Items such as food are stacked on the upper portions of the shelves 50.

A plurality of storage boxes 60 is arranged in the storage compartment 20 such that the storage boxes 60 are slidably moved into and out of the storage compartment 20. At least one of the storage boxes 60 is coupled to the lower portion of at least one of the shelves 50. The open upper portion of the storage box 60 may be covered by the shelf 50 such that the inner space of the storage box 60 may be sealed.

As shown in FIGS. 1 to 6, a plurality of shelves 50 is arranged in the storage compartment 20 to partition the storage compartment 20 into a plurality of sections and to allow food to be stacked on the upper portions thereof.

Provided at the left, right and rear edges of a shelf 50 is an extension portion 51, to which the gasket 80 is coupled to seal the inner space of the storage box 60 when the storage box 60 is coupled to the lower portion of the shelf 50.

The extension portion 51 includes a first extension portion 52 extending downward from the left, right and rear edges of the shelf 50, and a second extension portion 53 horizontally extending inside of the shelf 50 from the first extension portion 52.

The second extension portion 53 is provided with a fixing portion 54 to which the gasket 80 is fixed. The fixing portion 54 includes a fixing groove 55 having a recessed shape, and a fixing step 56 formed to protrude outward.

The fixing groove 55 has a recessed shape at the lower portion of the second extension portion 53, and an end portion of a hard part 81 of the gasket 80 is held by being inserted into the fixing groove 55.

In addition, the fixing step 56 is arranged to protrude downward from the lower portion of the second extension portion 53 to be adjacent to the fixing groove 55, and is inserted into the hard part 81 of the gasket 80 such that the gasket 80 is fixed to the second extension portion 53 of the shelf 50.

A seating portion 57 having a recessed shape is provided at the upper portion of the shelf 50 to allow the moisture-permeable membrane 90, which is adapted to adjust the humidity of the inner space of the storage box 60 sealed by the shelf 50, to be seated thereon. To prevent the moisture-permeable membrane 90 seated on the seating portion 57 from escaping from the seating portion 57, a cover 58 is provided at the upper portion of the seating portion 57. However, the present disclosures is not limited thereto. For example, a seating portion may be provided at the storage box 60 so that the moisture-permeable membrane may be installed at the storage box instead of the shelf.

The storage box 60, which is provided with an open upper portion to allow food to be accommodated therein, is moved into and withdrawn from the storage compartment 20 along a rail 70 arranged at sidewalls of the storage compartment 20 in a sliding manner.

The storage box 60 is coupled to the lower portion of the shelf 50 such that the inner space thereof is sealed by the shelf 50 as the open upper portion thereof is closed by the shelf 50.

A guide 61 is arranged at the left and right sidewalls of the storage box 60 to allow the storage box 60 to be guided along the rail 70 arranged at sidewalls of the storage compartment 20.

The guide 61 is provided with a protrusion 61 a to restrict further withdrawal of the storage box 60 when a predetermined portion of the storage box 60 is withdrawn from the storage compartment 20 along the rail 70. In addition, the rail 70 is provided with an engagement step 75 to block the protrusion 61*a*.

Accordingly, when the protrusion 61*a* of the guide 61 is blocked by the engagement step 75 of the rail 70 during withdrawal of the storage box 60 from the storage compartment 20, further withdrawal of the storage box 60 is not allowed and therefore separation of the storage box 60 from the storage compartment 20 is prevented.

Provided at the upper edges of the left and right sidewalls and front wall of the storage box 60 is an edge portion 63 horizontally extending to contact the gasket 80 fixed to the second extension portion 53 of the shelf 50 when the storage box 60 is coupled to the lower portion of the shelf 50.

In vertical arrangement of the second extension portion 53 of the shelf 50, the edge portion 63 of the storage box 60, and the gasket 80, the second extension portion 53 of the shelf 50 is positioned at the lowermost side, the gasket 80 fixed to the second extension portion 53 is positioned above the second extension portion 53, and the edge portion 63 of the storage box 60 is positioned above the gasket 80.

As shown in FIGS. 8 to 11, when the storage box 60 is guided along the rail 70 into the storage compartment 20, the storage box 60 is moved downward by the structure of the rail 70, which will be described later. Thereby, the edge portion 63 of the storage box 60 presses the gasket 80 arranged between the edge portion 63 and the second extension portion 53 of the shelf 50 to seal the gap between the second extension portion 53 of the shelf 50 and the edge portion 63 of the storage box 60. As a result, the inner space of the storage box 60 is sealed.

Provided on the rear portion, for example, the rear surface, of the storage box 60 is a handle 65 or a knob (not shown) which is grasped by a user to move the storage box 60 into or out of the storage compartment 20.

Figure 3:
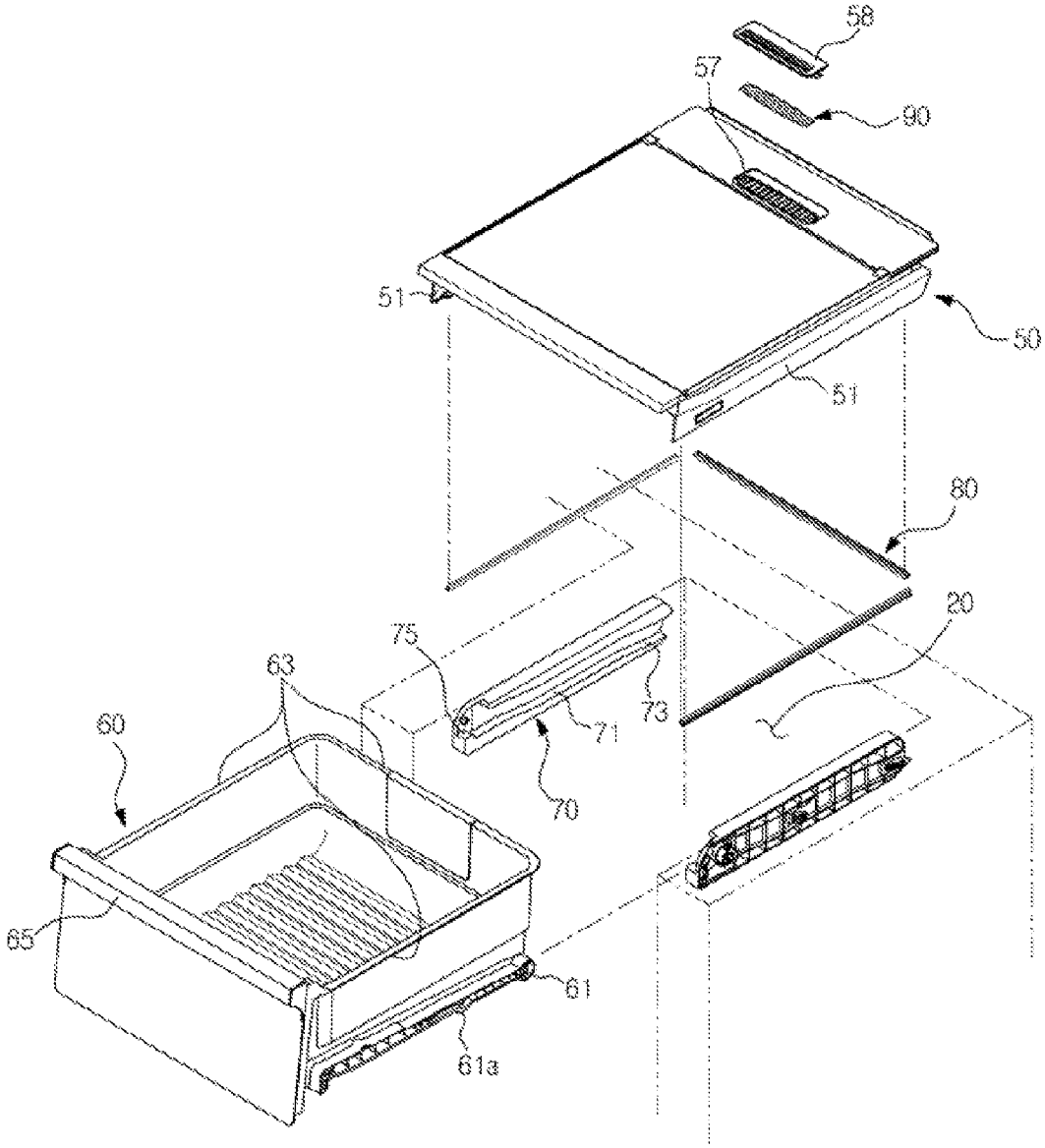
FIG. 3 is an exploded perspective view showing main constituents of the refrigerator of FIG. 1
Figure 4:
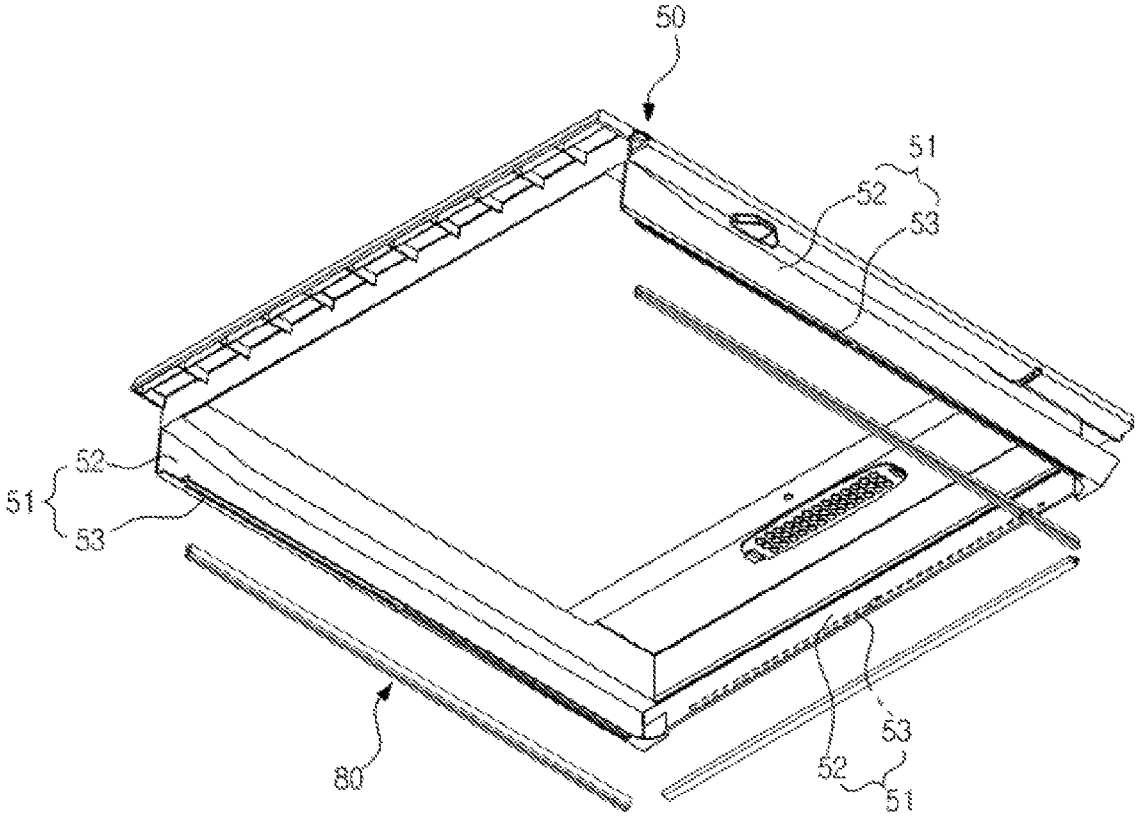
FIG. 4 is an exploded perspective view showing a shelf and a gasket according to one embodiment of the present disclosure.
Figure 7:
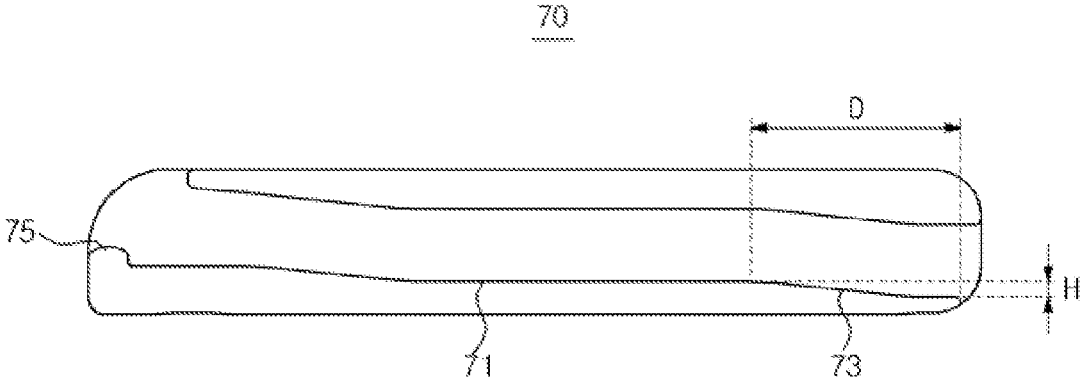
FIG. 7 is a view showing a rail according to an embodiment of the present disclosure.
Figure 8:
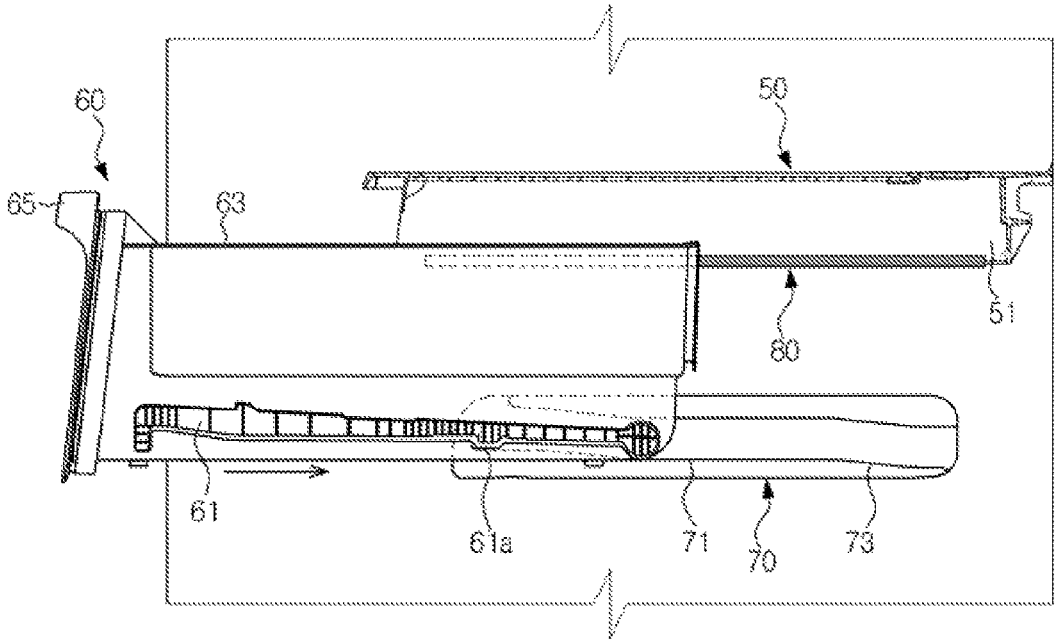
FIGS. 8, 9 and 10 are views illustrating movement of a storage box according to one embodiment of the present disclosure.
Figure 9:
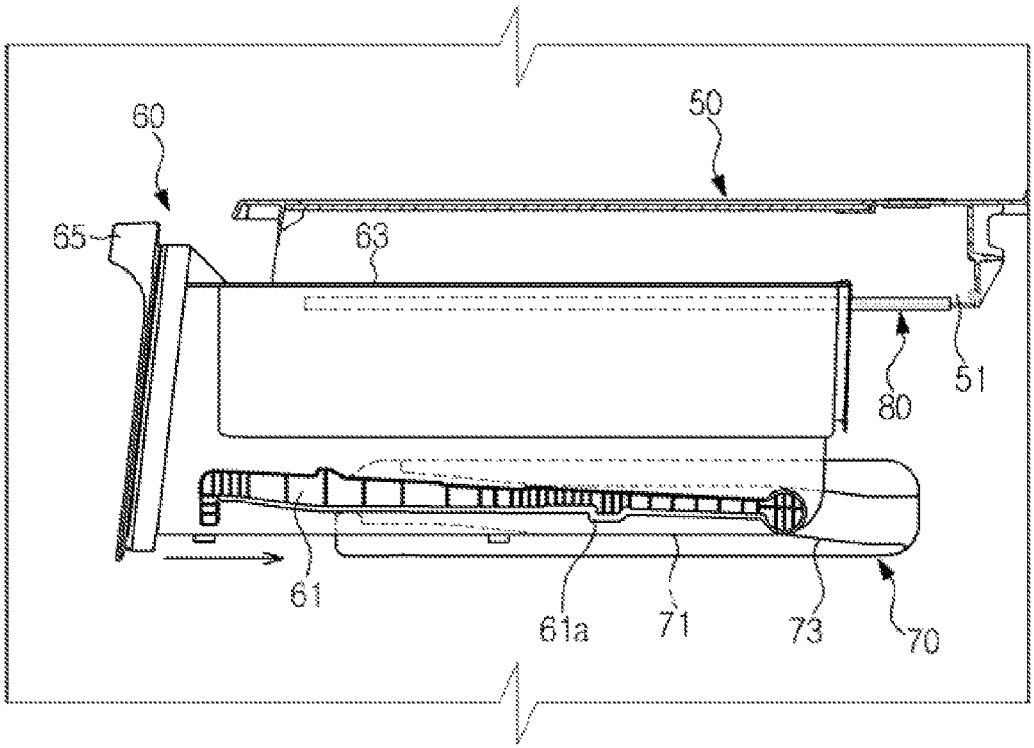
Figure 10:
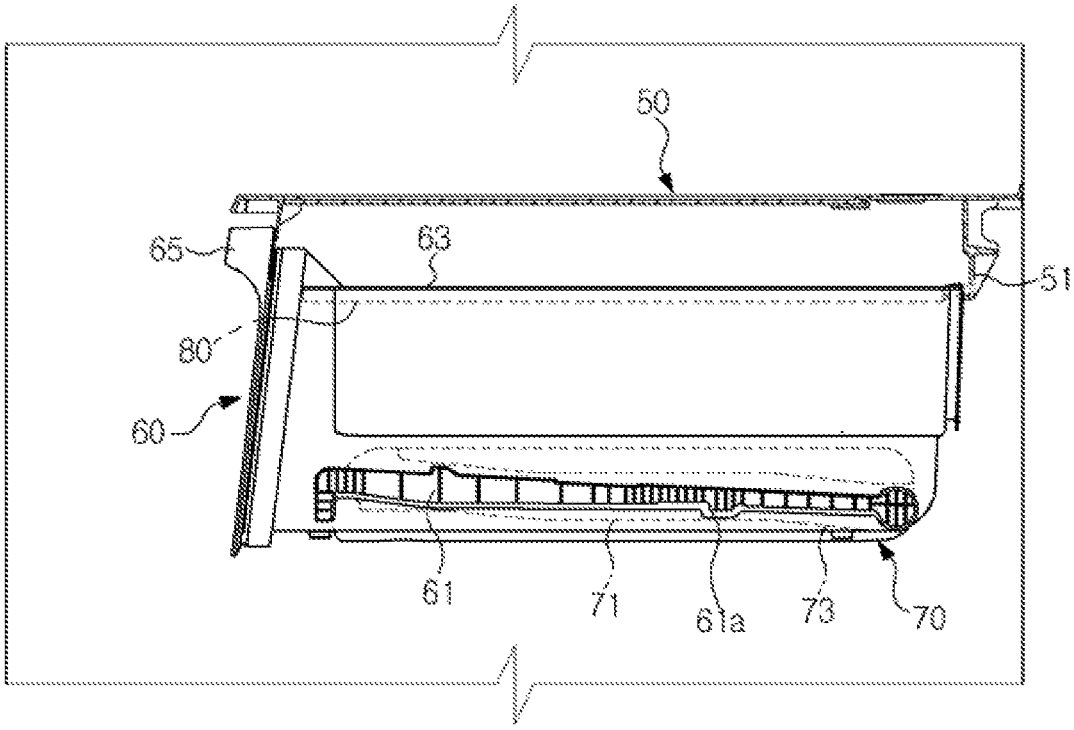

As shown in FIGS. 3 and 7, the rail 70 is provided at sidewalls of the storage compartment 20, and is formed to guide the guide 61 of the storage box 60 such that the storage box 60 is moved into or withdrawn from the storage compartment 20.

The rail 70 includes a horizontal portion 71 horizontally arranged to guide the guide 61 of the storage box 60 in a horizontal direction, and an inclined portion 73 arranged to be inclined downward from the end portion of the horizontal portion 71 to guide the guide 61 in the inclined direction.

The inclined portion 73 provided at the end portion of the horizontal portion 71 may be arranged at the rear end of the rail 70 to have a length D of approximately 50 mm, for example, and may be inclined such that the height H from the rear end portion to front end portion of the inclined portion 73 is approximately 7 mm, for example.

As shown in FIGS. 8 to 11, the storage box 60 is horizontally guided into the storage compartment 20 by the horizontal portion 71 of the rail 70, and is moved downward into the storage compartment 20 by the inclined portion 73 provided at the end portion of the horizontal portion 71.

The storage box 60 is moved into the storage compartment 20 along the horizontal portion 71 by the force applied by the user. Once the guide 61 enters the inclined portion 73, the storage box 60 moves downward along the inclined surface of the inclined portion 73 and enters the storage compartment 20 even if the user does not apply pushing force.

When the storage box 60 is moved downward along the inclined portion 73 of the rail 70, the edge portion 63 provided at the storage box 60 moves downward along with the storage box 60. As the edge portion 63 moves downward, it presses the gasket 80 arranged between the edge portion 63 and the second extension portion 53 of the shelf 50.

Since the gap between the edge portion 63 and the second extension portion 53 is sealed by the gasket 80, the inner space of the storage box 60 is also sealed.

Therefore, simply by an action of moving the storage box 60 into the storage compartment 20, the inner space of the storage box 60 may be sealed.

When the storage box 60 is withdrawn from the storage compartment 20, the storage box 60 is moved upward along the inclined surface of the inclined portion 73. Since the edge portion 63 is moved upward, sealing of the inner space of the storage box 60 may be released.

Figure 5:
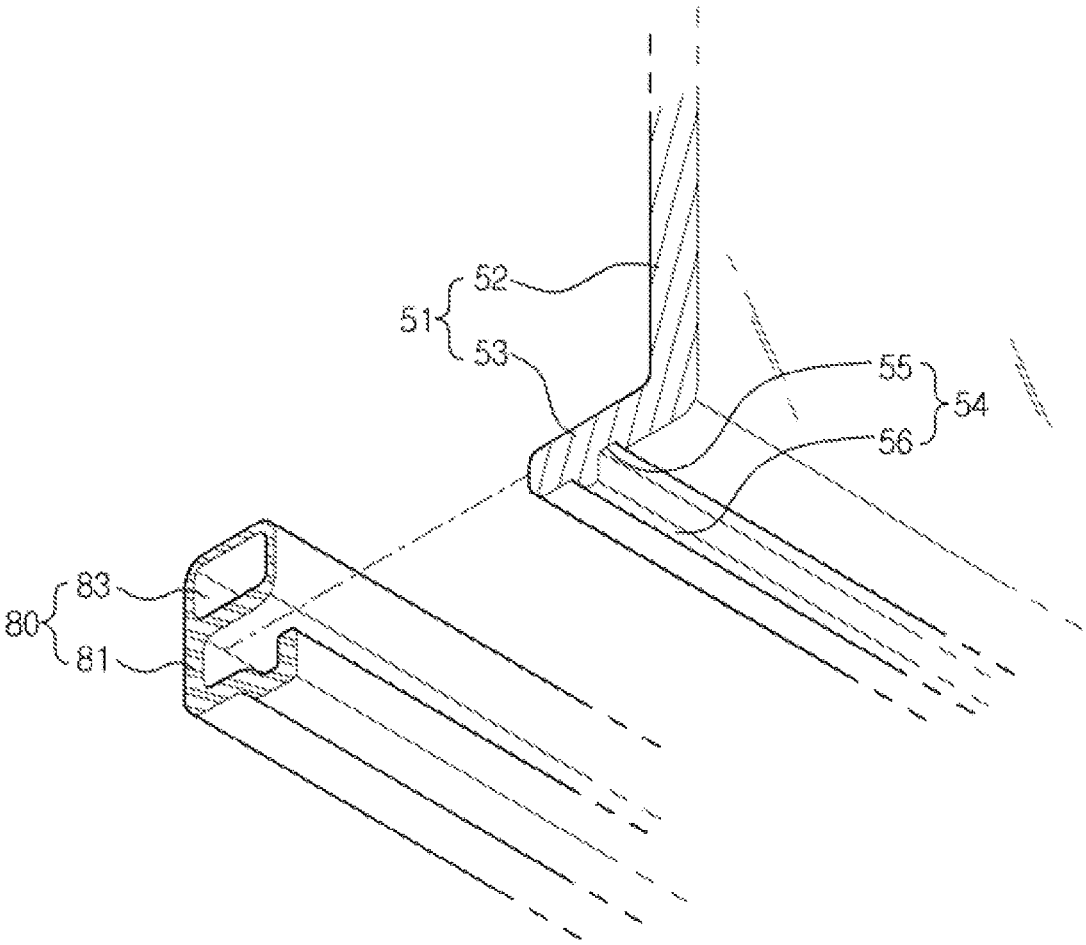
FIG. 5 is a view illustrating coupling of the gasket to a second extension portion of the shelf according to the illustrated embodiment.
Figure 6:
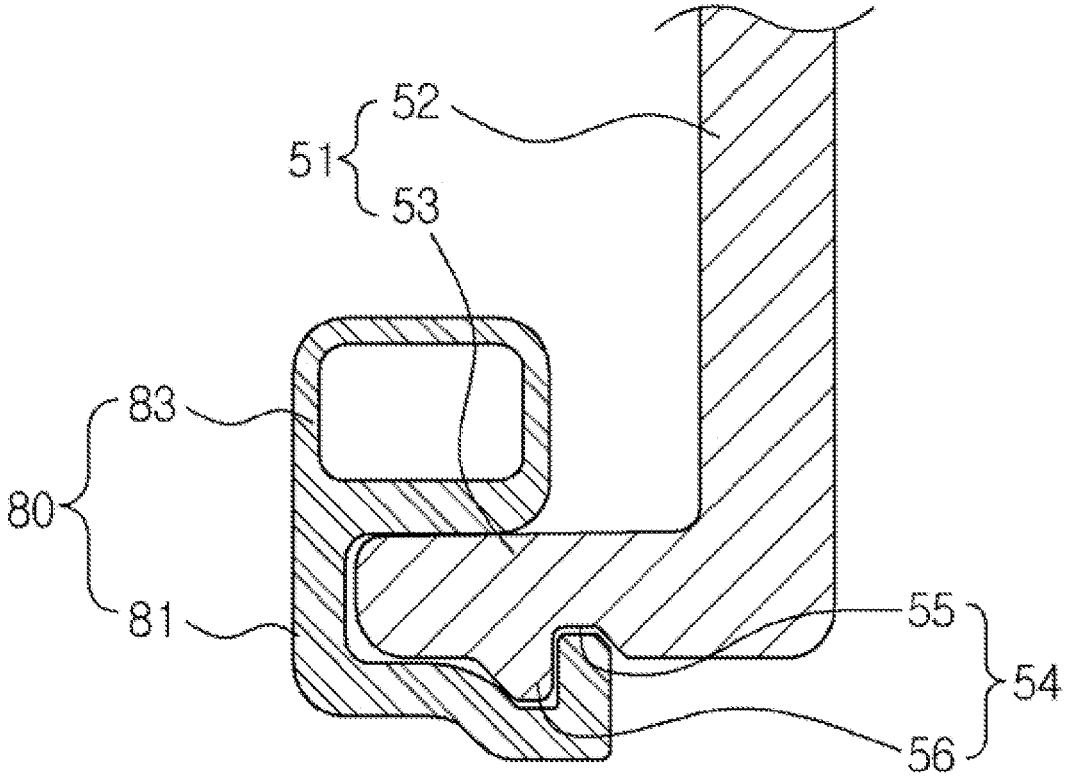
FIG. 6 is a cross-sectional view illustrating coupling of the gasket to the second extension portion of the shelf according to the illustrated embodiment.
Figure 11:
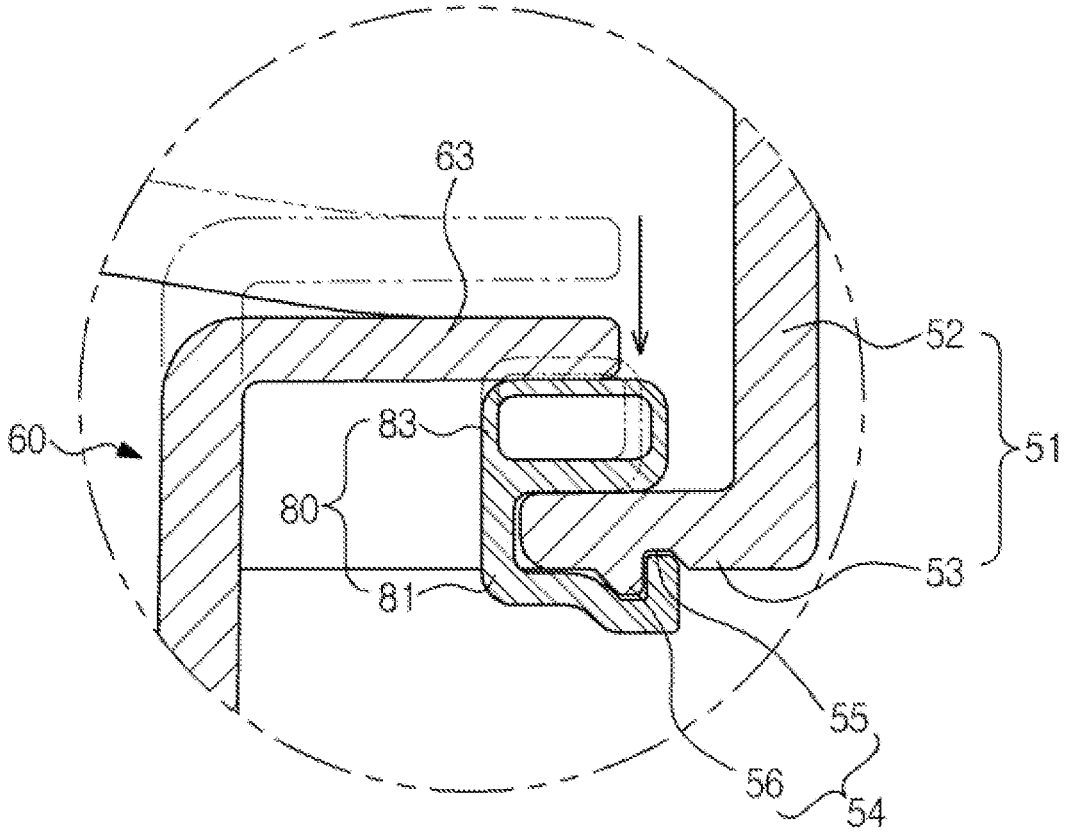
FIG. 11 is a view illustrating sealing of the inner space of the storage box according to the illustrated embodiment by the gasket as the storage box is closed.

As shown in FIGS. 5 to 6 and 11, the gasket 80 is fixed to the second extension portion 53 of the shelf 50, thereby sealing the gap between the edge portion 63 of the storage box 60 and the second extension portion 53. Thereby, the inner space of the storage box 60 is sealed by the gasket 80.

The gasket 80 is fixed to the fixing portion 54, which includes the fixing groove 55 having a recessed shape at the second extension portion 53 and the fixing step 56 protruding outward.

The gasket 80 includes a hard part 81 fixed to the fixing portion 54, and a soft part 83 to seal the gap between the second extension portion 53 of the shelf 50 and the edge portion 63 of the storage box 60 by being elastically deformed to closely contact the edge portion 63 of the storage box 60 when the storage box 60 is moved downward.

The hard part 81 is formed of, for example, Acrylonitrile Butadiene Styrene (ABS) resin or hardened Polyvinyl chloride (PVC), while the soft part 83 is formed of, for example, elastically deformable PVC.

As shown in FIG. 3, the moisture-permeable membrane is seated on the seating portion 57 provided on the shelf 50 to adjust the humidity of the inner space of the storage box 60 sealed by the shelf 50.

In the case that the humidity of the inner space of the storage box 60 is high, the moisture-permeable membrane allows moisture in the storage box 60 to pass therethrough such that moisture is discharged from the storage box 60. In the case that the humidity of the inner space of the storage box 60 is low, the moisture-permeable membrane blocks moisture from passing therethrough such that the moisture in the storage box 60 is not discharged from the storage box 60.

In the case that the humidity of the inner space of the storage box 60 is high, condensation in the storage box 60 may be prevented since the crystalline state of the moisture-permeable membrane is loosened, increasing moisture permeability and to allow moisture in the storage box 60 to be discharged through the moisture-permeable membrane.

In the case that the humidity of the inner space of the storage box 60 is low, drying of the inner space of the storage box 60 may be suppressed since molecules constituting the moisture-permeable membrane are crystallized, blocking discharge of moisture from the storage box 60 through the moisture-permeable membrane and increasing the humidity of the inner space of the storage box 60.

As is apparent from the above description, an inner space of a storage box may be sealed with a simple configuration, and food in the storage box may be kept fresh by adjusting the humidity of the sealed inner space of the storage box.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a body;

a storage compartment arranged in the body and having an open front portion;

a shelf arranged in the storage compartment and provided, at a lower portion of left, right and rear edge portions of the shelf, with an extension portion extending downward;

a storage box coupled to a lower portion of the shelf such that an open upper portion of the storage box is covered by the shelf and that the storage box is slidably inserted into or withdrawn from the storage compartment, the storage box being provided, at an upper edge portion of left, right and rear walls of the storage box, with an edge portion horizontally extending;

a plurality of rails provided at sidewalls of the storage compartment to guide the storage box such that the storage box is slidably inserted into or withdrawn from the storage compartment, the rails being provided, at a rear end portion thereof, with an inclined portion formed to be inclined downward;

a gasket coupled to the extension portion of the shelf such that, when the storage box is inserted along the rails into the storage compartment and thereby moved downward along the inclined portion, an upper portion of the gasket to closely contact with a lower portion of the edge portion of the storage box, to seal an inner space of the storage box; and a moisture-permeable membrane arrange at the shelf to adjust humidity of the sealed inner space of the storage box.

2. The refrigerator according to claim 1, wherein the shelf is fixed to an inside of the storage compartment to allow an item to be loaded onto an upper portion of the shelf.

3. The refrigerator according to claim 2, wherein the extension portion includes a first extension portion extending downward from the left, right and rear edges of the shelf, and a second extension portion horizontally extending from the first extension portion in an inward direction of the shelf.

4. The refrigerator according to claim 3, wherein the second extension portion is provided with a fixing portion to allow the gasket to be fixed thereto, and the fixing portion includes a fixing groove having a recessed shape and a fixing step protruding outward.

5. The refrigerator according to claim 4, wherein the gasket includes a hard part to be fixed to the fixing portion, and a soft part having elasticity to closely contact the edge portion of the storage box, the gasket being formed of a material for dual extrusion.

6. The refrigerator according to claim 1, wherein the storage box includes a guide provided on side portions of the storage box to be guided along the rails, and the guide is provided with a protrusion to restrict a distance the storage box is withdrawn.

7. The refrigerator according to claim 6, wherein the rails includes a horizontal portion horizontally arranged to guide the guide in a horizontal direction such that the storage box is moved into and withdrawn from the storage compartment, and an inclined portion arranged at an end portion of the horizontal portion to be inclined downward to guide the guide in an inclined direction.

8. The refrigerator according to claim 7, wherein the inclined portion has a length of approximately 50 mm at the end portion of the rails.

9. The refrigerator according to claim 7, wherein the inclined portion is inclined such that a front end portion of the inclined portion is approximately 7 mm higher than the rear end portion of the inclined portion.

10. The refrigerator according to claim 7, wherein, when the storage box is moved into the storage compartment, the guide is guided along the horizontal portion, and after passing the horizontal portion, the storage box is automatically guided downward along the inclined portion to be moved into the storage box.

11. The refrigerator according to claim 6, wherein the rails is provided with an engagement step to engage with the protrusion to restrict a distance the storage box is withdrawn.

12. The refrigerator according to claim 1, wherein the shelf is provided with a seating portion to allow the moisture-permeable membrane to be seated thereon, and a cover is arranged at an upper portion of the seating portion to prevent the moisture-permeable membrane from escaping the seating portion.

13. The refrigerator according to claim 12, wherein the moisture-permeable membrane discharges moisture in the inner space of the storage box when the humidity of the sealed inner space of the storage box is high, and maintains the moisture in the inner space of the storage box when the sealed inner space of the storage box is dry.

14. A refrigerator comprising:

a body;

a storage compartment arranged in the body and having an open front portion;

a shelf arranged in the storage compartment and provided, at a lower portion of left, right and rear edges of the shelf, with an extension portion to allow a gasket to be fixed thereto;

a storage box coupled to a lower portion of the shelf to be inserted into or withdrawn from the storage compartment, the storage box being provided, at an upper edge of left, right and rear walls of the storage box, with an edge portion such that the edge portion is positioned at an upper portion of the gasket; and a plurality of rails provided at sidewalls of the storage compartment to guide the storage box such that the storage box is inserted into or withdrawn from the storage compartment, the rails including a horizontal portion to guide the storage box in a horizontal direction, and an inclined portion arranged at an end portion of the horizontal portion to further guide the storage box in a diagonally downward direction, wherein, when the storage box is moved downward by the inclined portion during movement of the storage box into the storage compartment, the edge portion presses the gasket such that a gap between the shelf and the storage box is sealed by the gasket.

15. The refrigerator according to claim 14, wherein the shelf is provided with a moisture-permeable membrane to adjust humidity of a sealed inner space of the storage box.

16. The refrigerator according to claim 14, wherein the extension portion includes a first extension portion extending downward from the left, right and rear edges of the shelf, and a second extension portion horizontally extending from the first extension portion in an inward direction of the shelf, wherein the gasket is fixed to the second extension portion.

17. The refrigerator according to claim 14, wherein, when the storage box is moved into the storage compartment, the storage box is horizontally guided by the horizontal portion, and when introduced into the inclined portion via the horizontal portion, the storage box is guided downward to be automatically moved into the storage box.

18. A refrigerator storage unit comprising:

a refrigerator storage including a refrigerator storage body and an open upper portion, the refrigerator storage body including an edge portion horizontally extending from an upper edge portion of the refrigerator storage body;

a shelf having an extension portion extended from a lower portion of the shelf, the lower portion and the extension portion of the shelf being coupled to the refrigerator storage such that the open upper portion of the refrigerator storage is closed by the shelf;

a gasket fixed to the extension portion of the shelf and configured to engage with the edge portion of the refrigerator storage to seal an inner space of the refrigerator storage; and a plurality of rails provided at a refrigerator to guide the refrigerator storage to be inserted into or withdrawn from the refrigerator, the plurality of rails including a horizontal portion to guide the refrigerator storage in a horizontal direction, and an inclined portion arranged at an end portion of the horizontal portion to further guide the refrigerator storage downward along the inclined portion such that as the refrigerator storage moves along the inclined portion the edge portion moves downward to press the gasket.

19. The refrigerator storage unit of claim 18, further comprising a moisture-permeable membrane provided at the shelf to adjust humidity of sealed inner space of the refrigerator storage.

* * * * *